US005391095A

United States Patent [19]

Born

[11] Patent Number: 5,391,095

[45] Date of Patent: Feb. 21, 1995

[54] ENHANCEMENT OF 10 BASE T NETWORKS

[75] Inventor: Timothy D. Born, St. Charles, Ill.

[73] Assignee: AT&T Corp., Murray Hill, N.J.

[21] Appl. No.: 114,565

[22] Filed: Aug. 31, 1993

[51] Int. Cl.[6] ..... H01R 23/02

[52] U.S. Cl. ..... 439/676; 439/638

[58] Field of Search ..... 439/344, 676, 638–654

[56] References Cited

U.S. PATENT DOCUMENTS

| | | | |
|---|---|---|---|
| 4,290,664 | 9/1981 | Davis et al. | 439/638 |
| 4,392,701 | 7/1983 | Weidler | 439/638 |
| 4,944,698 | 7/1990 | Siemon et al. | 439/638 |
| 5,178,554 | 1/1993 | Siemon et al. | 439/676 |

OTHER PUBLICATIONS

"StarLAN 10 Network, Attachment Unit Interface Adapter Installation Guide", (Brochure (Excerpt)), AT&T, 1989, pp. 1, 33, and front page.

"StarLan 10 Network, Hub Unit Installation Guide", (Brochure (Excerpt)), AT&T, 1989, pp. 1, 93, and front page.

*Primary Examiner*—David L. Pirlot

*Attorney, Agent, or Firm*—Werner Ulrich

[57] ABSTRACT

A connecting block is used to connect a single 10 base T cable to two separate devices such as computer terminals or personal computers. The connecting block allows a single cable arranged to transfer signals for a single computer terminal or personal computer to two such devices by separating the signals in the cable into two sets of the four signals required to carry signals to such devices. Advantageously, the building wiring for 10 base T networks can have its capacity essentially doubled without performing any rewiring or adding electronic equipment.

4 Claims, 3 Drawing Sheets

ENHANCEMENT OF 10 BASE T NETWORKS

TECHNICAL FIELD

This invention relates to connecting blocks for use with internal telephone cable for data networks.

PROBLEM

Internal telephone cables are widely used for interconnecting communicating devices, such as computer terminals, personal computers, and computer communication devices, in data networks. The bandwidth requirements for communications among such devices are frequently satisfied by the use of twisted pair cable and do not require much more expensive coaxial cable. A very common arrangement which uses such twisted pair cable is the 10 base T network, which is specified in an addendum to the ANSI/IEEE Standard 802.3. This network uses cables terminated at each end by a standard eight-wire telephone connector of the same type that is used extensively in household telephones. (For example, the plug connected to a common telephone instrument is of this type.)

Buildings housing large numbers of networked personal computers and other terminals usually have jacks connected to such a 10 base T network (frequently using the ETHERNET TM *protocol) in most offices. Extensive wiring interconnects these jacks. This wiring is expensive and the cost of snaking the wiring through ceilings and ducts is even more expensive. A problem that exists in the prior art is that as additional terminals are installed in an office, the installation of additional jacks and the connected wiring is expensive.

SOLUTION

The standard wires interconnecting the standard telephone jacks are eight wires (four twisted pairs) of which only four are used in the standard 10 base T networks. An advance is made over the prior art in accordance with my invention wherein a single jack on a connecting block is connectable to an eight-wire cable terminated on an eight-wire plug and the wires on the single jack are connected internally within the connecting block to a pair of eight-wire jacks, only four of the wires being connected to each of the jacks. Advantageously, each of the pair of jacks of the connecting block can be connected via a plug and cable to a communication device such as a terminal or personal computer so that the 8-wire internal cable within a building can be used for connecting two computer terminals or personal computers instead of one to the intrabuilding network. In effect, a user of a terminal or personal computer (PC) cannot tell whether the user is connected via one of these connecting blocks (wherein each 8-wire cable carries signals for one or two PCs), or is directly connected without using such a connecting block (wherein each 8-wire cable carries signals for only one PC).

In accordance with another embodiment of the invention, the eight-wire cable is directly terminated within a simpler connecting block to the pair of jacks of the connecting block. This saves the cost of a separate plug and jack pair for terminating the intrabuilding cable and may be advantageous when new intrabuilding cables are being installed for an office.

DRAWING DESCRIPTION

DETAILED DESCRIPTION

Figure 1:
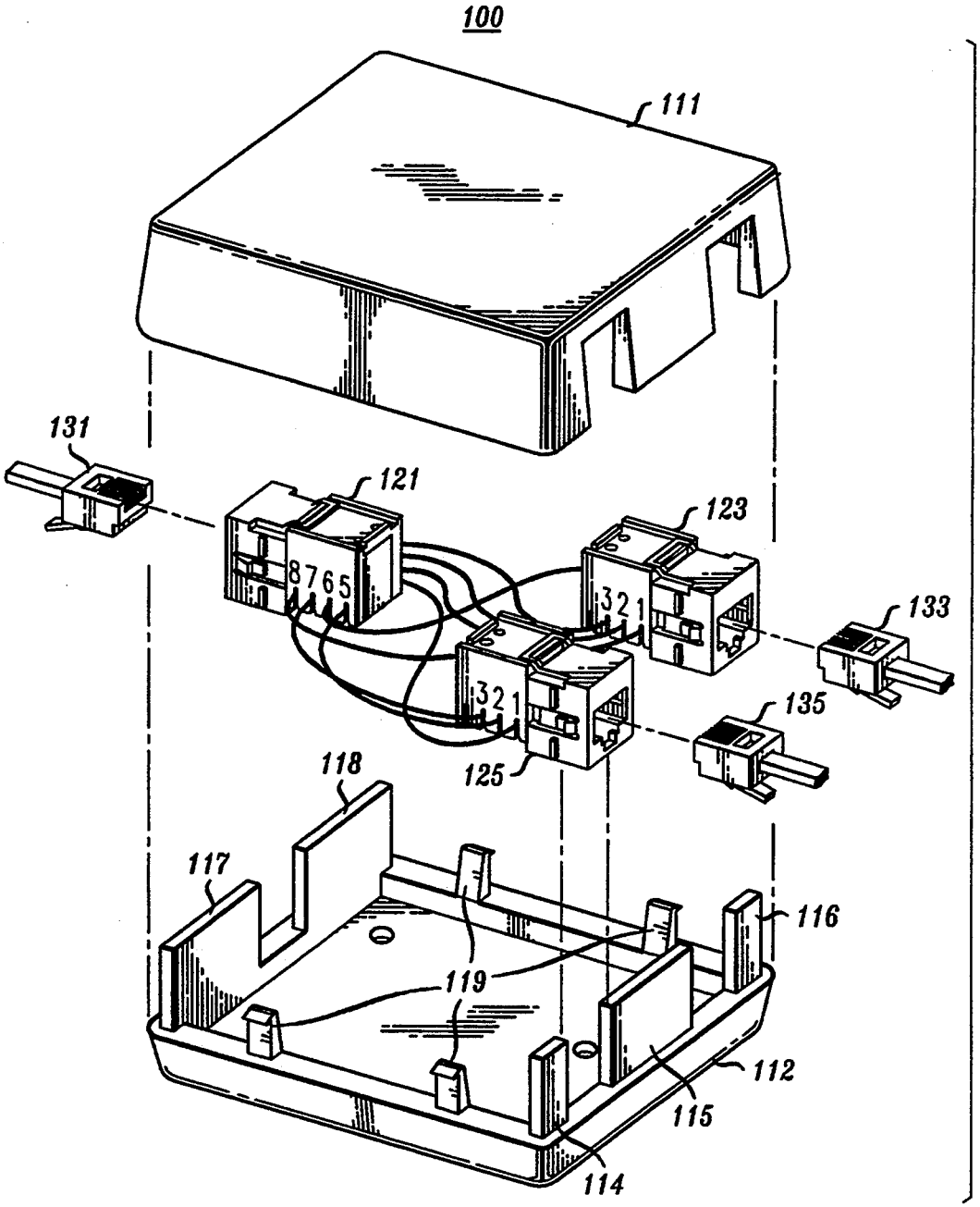
FIG. 1 is an exploded perspective view of an exemplary connecting block.

FIG. 1 is an exploded perspective view of an exemplary embodiment of a connecting block 100. This connecting block 100 consists of a base 112, a cap 111, three 8-wire standard telephone jacks 121, 123, and 125, and wiring interconnecting the three jacks. The three jacks 121, 123, and 125, are held in place by tabs 114, 115; 115, 116; and 117, 118, respectively. The cap 111 is held to the base 112 by four snap-tabs 119. Plugs 131, 133, and 135, which are not part of connecting block 100 are shown; these are meant to plug into jacks 121, 123, and 125, respectively. The wiring between the jacks is discussed with respect to FIG. 3.

Figure 2:
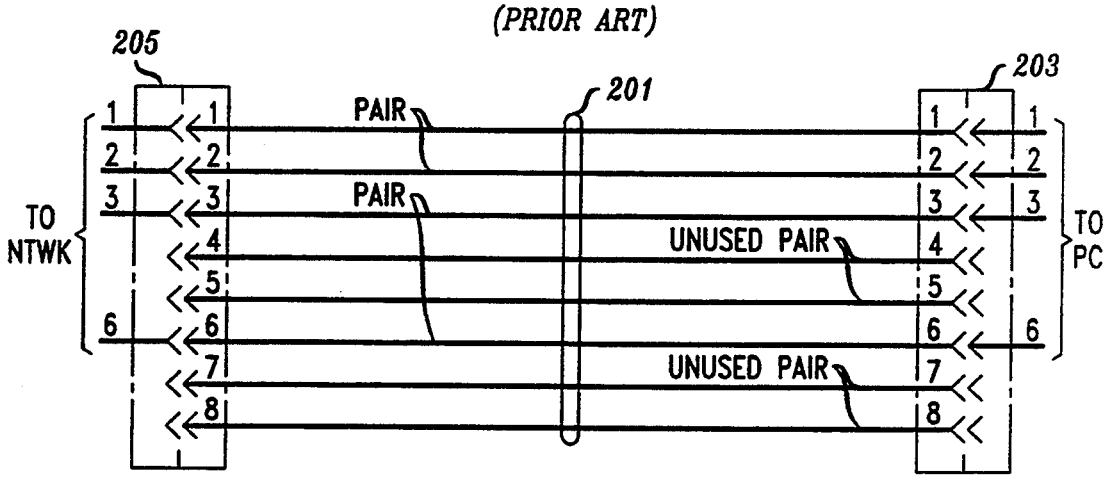
FIG. 2 (PRIOR ART)
FIG. 2 is a wiring diagram of the wiring of the prior art.

FIG. 2 shows the wiring of the prior art. An 8-wire cable 201 interconnects jack-plug pairs 203 and 205. Note that only four of the wires entering jack-plug pairs 203 and 205 are active.

Figure 3:
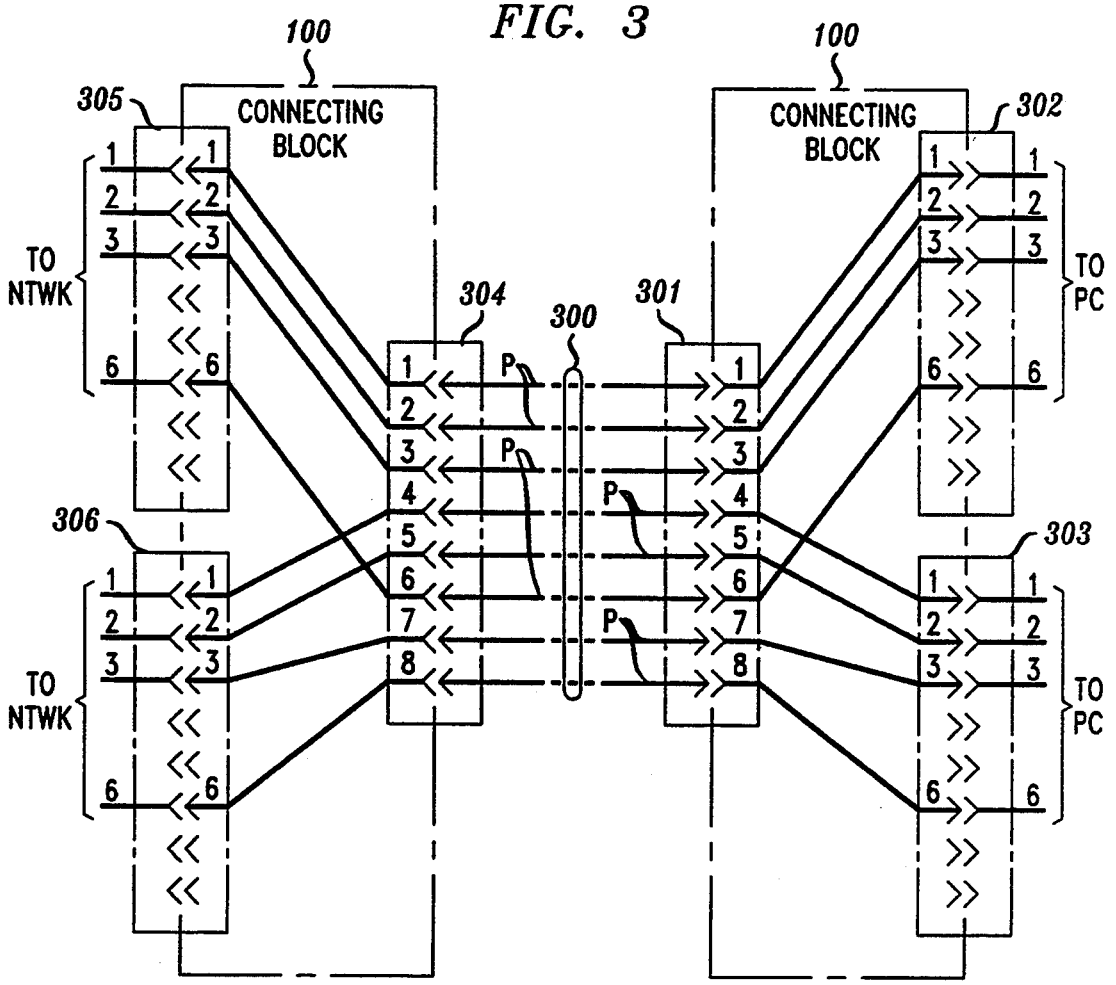
FIGS. 3 and 4 are wiring diagrams of interconnections using the connecting blocks of applicant's invention.

FIG. 3 is a wiring diagram illustrating applicant's invention. Eight-wire cable 300, corresponding to eight-wire cable 201 of FIG. 2, interconnects jack and plug pairs 301 and 304. Four of the wires of jack 301 are connected to the jack of 302, and the other four are connected to the jack of 303. Two sets of inputs are then connectable to the plugs of the jack-plug pairs 302 and 303. On the left side, jack-plug pair 304 is connected to cable 300. The output of the jack of 304 has four wires connected to jack-plug pair 305 and the other four wires connected to jack-plug pair 306.

For the case in which existing wiring has already been terminated in an office on an existing jack, all eight wires of cable 300 are normally connected to such a jack. A short eight-wire cable with plugs on two ends can then have one end inserted in that jack, and the other end into jack 301 of connecting block 100. A similar procedure can also be followed at the other end of cable 300. The result is that a cable which was only capable of handling both ends of a connection to a single computer terminal or personal computer can now carry signals for two such connections.

Figure 4:
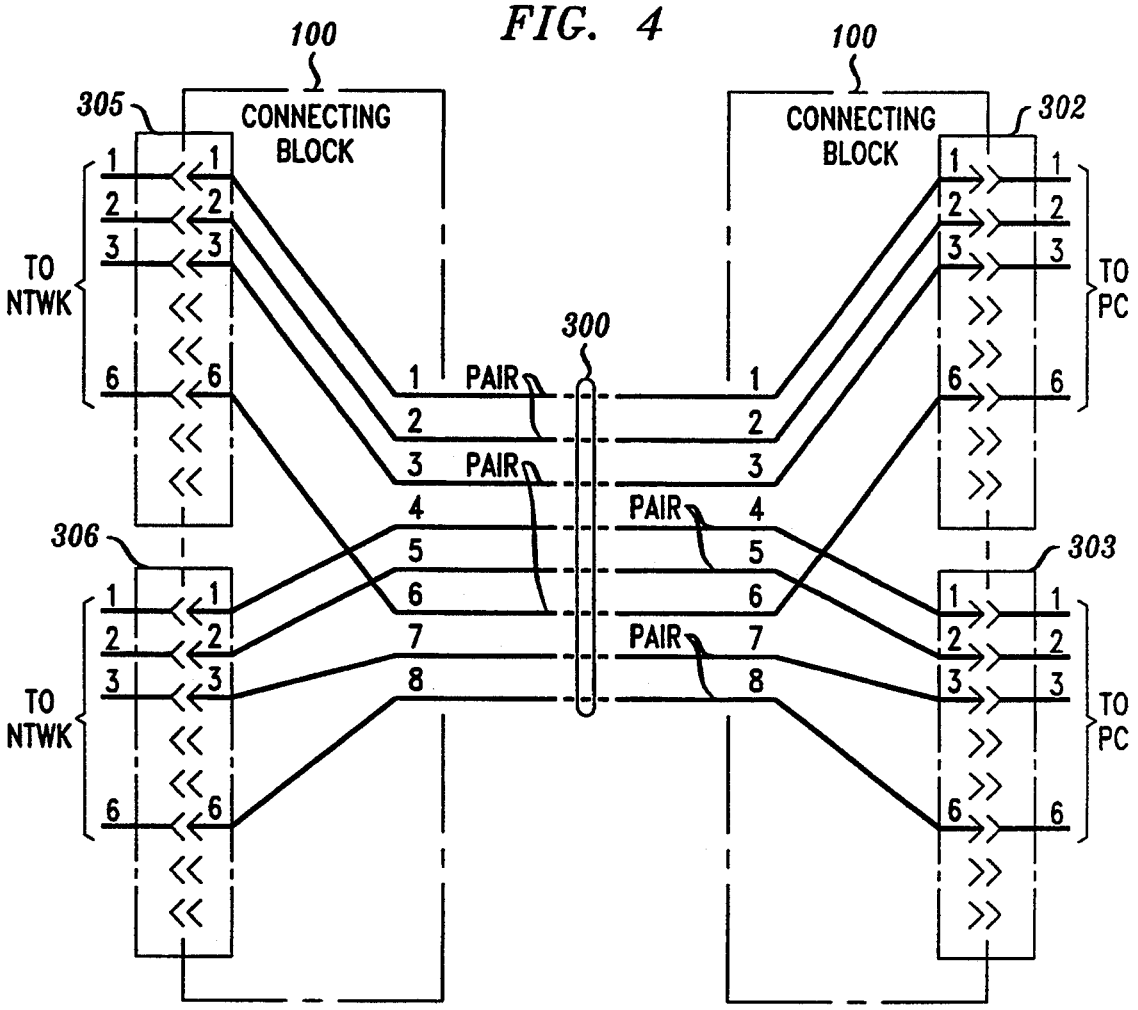

FIG. 4 illustrates the situation wherein a cable is directly terminated on a simpler connecting block. The cable is terminated in such a way that half of its outputs are connected to jack 302 and the other half are connected to jack 303. A plug will then connect the cable to a computer terminal or personal computer.

It is to be understood that the above description is only of one preferred embodiment of the invention. Numerous other arrangements may be devised by one skilled in the art without departing from the scope of the invention. The invention is thus limited only as defined in the accompanying claims.

I claim:

1. A connecting block for use with eight-wire twisted pair signal cables comprising:

one jack having eight terminals for connection via a plug to one end of an eight-wire twisted pair signal cable; and two jacks, each having eight terminals, each for connection via a plug to one end of each of two additional twisted pair signal cables;

each of said two jacks for connecting one four-wire signal set from a predetermined set of terminals of said each jack via one of said additional twisted pair signal cables to a communication device or data network termination;

four of the terminals of said one jack being connected to said predetermined set of four terminals of a first of said two jacks, and the other four terminals of said one jack being connected to said predetermined set of four terminals of a second of said two jacks.

2. The connecting block of claim 1 wherein said predetermined set of four terminals of one of said two jacks is connected to said predetermined set of four terminals of said one jack.

3. A connecting block for use with eight-wire twisted pair signal cables comprising:

two jacks each connectable to an eight-wire twisted pair cable, each jack for connection via a plug to one end of each of two additional twisted pair signal cables, each of said additional signal cables for connecting one four-wire signal set from a predetermined set of terminals of one of said two jacks to a communicating device or data network termination;

four of the wires of said eight-wire twisted pair cable being connectable to said predetermined set of four terminals of a first of said two jacks, and the other four wires of eight-wire twisted pair cable being connectable to said predetermined set of four terminals of a second of said two jacks.

4. The connecting block of claim 3 wherein said predetermined set of four terminals of one of said two jacks is connected to a corresponding set of four wires of said eight-wire twisted pair cable.

* * * * *